US011319672B2

(12) United States Patent
Backfolk et al.

(10) Patent No.: US 11,319,672 B2
(45) Date of Patent: May 3, 2022

(54) METHOD FOR PRODUCTION OF A PRODUCT COMPRISING A FIRST PLY

(71) Applicant: Stora Enso OYJ, Helsinki (FI)

(72) Inventors: Kaj Backfolk, Lappeenranta (FI); Isto Heiskanen, Imatra (FI); Esa Saukkonen, Lappeenranta (FI)

(73) Assignee: Stora Enso OYJ, Helsinki (FI)

( * ) Notice: Subject to any disclaimer, the term of this patent is extended or adjusted under 35 U.S.C. 154(b) by 33 days.

(21) Appl. No.: 16/975,786

(22) PCT Filed: Feb. 25, 2019

(86) PCT No.: PCT/IB2019/051484
§ 371 (c)(1),
(2) Date: Aug. 26, 2020

(87) PCT Pub. No.: WO2019/166929
PCT Pub. Date: Sep. 20, 2019

(65) Prior Publication Data

US 2020/0407918 A1 Dec. 31, 2020

(30) Foreign Application Priority Data

Feb. 27, 2018 (SE) ..... 1850222-9

(51) Int. Cl.

| | |
|---|---|
| ***D21H 11/18*** | (2006.01) |
| ***D21H 13/08*** | (2006.01) |
| ***D21H 13/10*** | (2006.01) |
| ***D21H 17/28*** | (2006.01) |
| ***D21H 17/33*** | (2006.01) |
| ***D21H 17/68*** | (2006.01) |
| ***D21H 21/10*** | (2006.01) |
| ***D21H 21/18*** | (2006.01) |
| ***D21H 21/52*** | (2006.01) |
| ***D21H 23/48*** | (2006.01) |

(52) U.S. Cl.
CPC ..... *D21H 11/18* (2013.01); *D21H 13/08* (2013.01); *D21H 13/10* (2013.01); *D21H 17/28* (2013.01); *D21H 17/33* (2013.01); *D21H 17/68* (2013.01); *D21H 21/10* (2013.01); *D21H 21/18* (2013.01); *D21H 21/52* (2013.01); *D21H 23/48* (2013.01)

(58) Field of Classification Search
USPC ..... 162/146
See application file for complete search history.

(56) References Cited

U.S. PATENT DOCUMENTS

| | | | |
|---|---|---|---|
| 2010/0024998 | A1 | 2/2010 | Wildlock et al. |
| 2010/0065236 | A1 | 3/2010 | Henriksson et al. |
| 2012/0219816 | A1 | 8/2012 | Heiskanen et al. |
| 2013/0017349 | A1 | 1/2013 | Heiskanen et al. |
| 2013/0292075 | A1 | 11/2013 | Laine et al. |
| 2013/0299109 | A1 | 11/2013 | Hietaniemi et al. |
| 2017/0284030 | A1 | 10/2017 | Svending et al. |
| 2017/0342661 | A1 | 11/2017 | Aulin et al. |

FOREIGN PATENT DOCUMENTS

| | | | |
|---|---|---|---|
| AU | 2016203734 | A1 | 12/2016 |
| CN | 101563504 | A | 10/2009 |
| CN | 102695832 | A | 9/2012 |
| CN | 103140626 | A | 6/2013 |
| WO | 2009040471 | A2 | 4/2009 |
| WO | 2014029917 | A1 | 2/2014 |
| WO | 2016185332 | A1 | 11/2016 |
| WO | 2017046749 | A1 | 3/2017 |
| WO | 2017149214 | A1 | 9/2017 |
| WO | 2017175062 | A1 | 10/2017 |

*Primary Examiner* — Mark Halpern
(74) *Attorney, Agent, or Firm* — Greer, Burns & Crain, Ltd.

(57) ABSTRACT

The present invention relates to a method for production of product comprising a first ply, the method comprising the steps of: providing a fibrous suspension comprising fibers; providing said fibrous suspension to a porous medium to form a substrate comprising fibers; providing a first additive suspension comprising a first strengthening agent, wherein the first strengthening agent is microfibrillated cellulose; providing a second additive suspension comprising at least one retention agent and/or at least one drainage agent; dewatering said substrate on said porous medium; performing additive addition to said substrate during said dewatering of said substrate on said porous medium, wherein the additive addition is performed when the substrate has a dry content of less than 20 weight-%, preferably less than 10 weight-%, most preferably less than 7 weight-%, and wherein the additive addition comprises adding at least a layer of said first additive suspension and a layer of said second additive suspension to said substrate by means of multilayer curtain coating, and further dewatering and drying said substrate after said dewatering on said porous medium so as to provide said first ply. The invention also relates to a paper, board or non-woven product obtainable by the method.

18 Claims, No Drawings

METHOD FOR PRODUCTION OF A PRODUCT COMPRISING A FIRST PLY

This application is a U.S. National Phase under 35 U.S.C. § 371 of International Application No. PCT/IB2019/051484, filed Feb. 25, 2019, which claims priority under 35 U.S.C. §§ 119 and 365 to Swedish Application No. 1850222-9, filed Feb. 27, 2018.

TECHNICAL FIELD

The present invention relates to a method for production of a product comprising a first ply wherein microfibrillated cellulose (MFC) is utilized as an additive for improving at least the strength properties of the first ply. In addition, the present invention relates to a paper, board or non-woven product obtainable by the method.

BACKGROUND

It is known to utilize different chemicals or agents as additives in the production of paper and board products to provide the paper and board products with desired properties, functionality or to improve the production and process runnability. One additive that has gained more interest during the recent years is microfibrillated cellulose (MFC).

It has previously been described to use MFC as a surface sizing or surface coating chemical in order to, for example, improve barrier properties, enhance printability or improve bonding between different plies of a paper or board product. The characteristic particle shape and size distribution of MFC will then result in a strong tendency for MFC to stay on or close to the surface. However, since MFC has a high water binding capacity, gelling behavior and because of immobilization at the surface of the plies, MFC located at the surface will have a surface densification or clogging effect and thereby a negative influence on dewatering.

It has also previously been described to use MFC as a wet end additive for the purpose of acting as a performance or process chemical in the production of paper and board products. For example, it has been described to add MFC to the stock in the production of paper and board products in order to provide strength properties, to provide bending stiffness, to provide creep resistance, to provide retention of materials and chemicals used during the production and to lower the porosity of the formed paper or board product.

The unique properties of using MFC as a wet end additive for providing i.a. strength properties are based on the fact that MFC has a high surface area (i.e. preferably in wet, non-consolidated or non-hornificated form) and high amounts of available sites which promote e.g. hydrogen bonding between materials such as fibers, fines, fillers, plastics or water-soluble polymers such as starch.

However, MFC has a tendency to self-associate or reorganize, whereby efficient mixing devices are required when MFC is dosed into the stock as a wet end additive. In addition, the retention of MFC itself after provision of the stock including MFC to a porous medium for dewatering has been shown to be poor or limited for many stock compositions. This implies in turn that the desired improvement of properties provided by the use of MFC as an additive included in the stock, e.g. improvement of strength properties, is poor or limited. In addition, the poor or limited retention of MFC has negative effects such as change of chemical retention and/or material retention.

AU2016203734 describes that nano-particles, which may include MFC, may be incorporated in a paper sheet by adding the nano-particles to a paper pulp slurry feed to the headbox of a papermaking machine so that the nano-particles is distributed through the ply layer of the headbox, by spraying nano-particles onto a face of one or more ply layers on a wire at the wet end of the paper machine and applying another ply layer there over, or by adding the nano-particles to the ply after ply layers have been joined together (e.g. in a size press or by a meter press roll).

However, there is still room for improvements of methods for production of a product, e.g. a paper, board or nonwoven product comprising a first ply, which methods involve use of MFC as an additive for improving at least the strength properties of the first ply and, thus, of the provided product.

SUMMARY

It is an object of the present disclosure to provide an improved method for production of a product, such as e.g. a paper, board or nonwoven product, comprising a first ply, which method involves use of MFC as an additive for improving at least the strength properties of the first ply and, thus, of the provided product, and which method eliminates or alleviates at least some of the disadvantages of the prior art methods.

As a first aspect of the present disclosure, there is provided a method for production of a product comprising a first ply, the method comprising the steps of:

- providing a fibrous suspension comprising fibers;
- providing said fibrous suspension to a porous medium to form a substrate comprising fibers;
- providing a first additive suspension comprising a first strengthening agent, wherein the first strengthening agent is microfibrillated cellulose;
- providing a second additive suspension comprising at least one retention agent and/or at least one drainage agent;
- dewatering said substrate on said porous medium;
- performing additive addition to said substrate during said dewatering of said substrate on said porous medium, wherein the additive addition is performed when the substrate has a dry content of less than 20 weight-%, preferably less than 10 weight-%, most preferably less than 7 weight-%, and wherein the additive addition comprises adding at least a layer of said first additive suspension and a layer of said second additive suspension to said substrate by means of multilayer curtain coating, and
- further dewatering and drying said substrate after said dewatering on said porous medium so as to provide said first ply.

It has surprisingly been found that by addition of MFC to the wet substrate at a position at which the wet substrate has a low dry content, i.e. a dry content of less than 20 weight-%, during dewatering on the porous medium during production of the first ply according to the method of the first aspect, the retention of MFC in the wet substrate is improved when compared to addition of MFC as an additive to the stock. Since the retention of MFC in the wet substrate is improved, the strength enhancing effect of MFC is improved. Thus, the addition of MFC to the wet substrate in accordance with the method of the first aspect is advantageous for the strength enhancing effect of MFC.

Furthermore, the retention of MFC in the wet substrate is further improved by the additional addition of at least one retention agent and/or at least one drainage agent to the wet substrate at a position at which the wet substrate has a low dry content, i.e. a dry content of less than 20 weight-%, during dewatering on the porous medium during production of the first ply according to the method of the first aspect.

As mentioned above, MFC has a high water binding capacity. However, the additional addition of at least one retention agent and/or at least one drainage agent implies also that the dewatering is improved.

In addition, by adding MFC to the wet substrate at a position at which the wet substrate has a low dry content during dewatering on the porous medium during production of the first ply according to the method of the first aspect, the penetration/infiltration of MFC, and the retention/drainage agent(s), into the wet substrate is improved compared to addition of MFC and the retention/drainage agent(s) at a position at which the wet substrate has a high dry content, e.g. higher than 20 weight-%.

Improved penetration/infiltration of MFC and the retention/drainage agent(s) into the wet substrate implies that the distribution of MFC and the retention/drainage agent(s) in the z direction of the wet substrate is improved. A good distribution of MFC and the retention/drainage agent(s) in the z direction of the wet substrate is advantageous for the strength enhancing effect of MFC.

Also, if addition of MFC to the substrate when the substrate has a high dry content, e.g. higher than 20 weight-%, would be applied, the dewatering properties would be negatively influenced due to the high water binding capacity of MFC, i.e. the densification or clogging effect of MFC.

It has also surprisingly been found that the strength enhancing effect of MFC is further improved by adding MFC (i.e. the first additive suspension comprising MFC) in one layer to the wet substrate and adding the at least one retention agent and/or at least one drainage agent (i.e. the second additive suspension comprising at least one retention agent and/or at least one drainage agent) in another layer to the wet substrate at a position at which the wet substrate has a low dry content by means of the technique of multilayer curtain coating according to the method of the first aspect. By using multilayer curtain coating for addition of the layers of the first and second additive suspensions at a position at which the wet substrate has a low dry content according to the method of the first aspect, the penetration/infiltration of MFC and the retention/drainage agent(s) into the wet substrate is facilitated/improved. This is due to the fact that the multilayer curtain coating enables simultaneous dosing or non-simultaneous dosing of two or more chemical layers by curtain coating onto a web, which preferably have low consistency. The low consistency and curtain application provides further improved infiltration, especially if dewatering occurs and continues on the wire (wet section).

Also, the method of the first aspect is advantageous in that it is associated with a possibility to influence/control/regulate the dewatering properties. This is due to the fact that the addition of MFC in one layer and the addition of at least one retention agent and/or at least one drainage agent in one layer by means of multilayer curtain coating imply that there is a possibility to influence/control/regulate the amount of MFC as well as the amount and type of retention/drainage chemical(s) added to the wet substrate so as to influence/control/regulate the dewatering. This means, in turn, that there is a possibility to influence/control/regulate the strength enhancing effect of the MFC. Consequently, with the method of the first aspect it is possible to produce a product, e.g. a paper, board or nonwoven product with improved or tailor made structure to optimize the bending stiffness, the elastic modules, the dimension stability such as curling, the mouldability, the creasing properties, the compression strength of the product.

Furthermore, the method of the first aspect is advantageous in that the need of efficient mixing devices, which might be required when MFC is dosed as an additive into the stock, may be reduced or eliminated.

The method of the first aspect may be a method for production of a paper, board or nonwoven product comprising a first ply.

The method of the first aspect may be carried out in a papermaking machine. The papermaking machine that may be used in the method of the first aspect may be any conventional type of machine known to the skilled person used for the production of paper, board, tissue, nonwoven or similar products, but which has been provided with equipment for performing the additive addition (i.e. equipment including means for performing the multilayer curtain coating).

As used herein, the term "board" refers not only to board, but also to cardboard, cartonboard and paperboard, respectively.

As used herein, the term "ply" means either top ply, mid ply or back ply or any or all plies in a multi-ply structure. The ply can thus be single or multiply substrate. The invention disclosed herein, can be used for one or several plies.

In addition to the various end substrates described above, the plies are preferably a part of corrugated board, liquid packaging board (LPB), folding box board (FBB), multilayer paper such as flexible paper products, multilayered grease proof papers, solid unbleached board (SUB), solid bleached board (SBB), white lined chipboard (WCB), etc.

The provided fibrous suspension may comprise cellulose fibers and the cellulose fibers preferably has a Schopper Riegler value of 12-50° , preferably 15-30°. Thus, the fibrous suspension comprises then cellulose fibers suitable for producing a porous paper or board ply. The Schopper Riegler value can be determined through the standard method defined in EN ISO 5267-1.

The fibrous suspension may comprise one type of cellulose fibers. However, alternatively the fibrous suspension may comprise a mixture of different types of cellulose fibers. For example, the cellulose fibers of the fibrous suspension may comprise fibers from unbleached and/or bleached pulp. The unbleached and bleached pulp may be chemical pulp, such as kraft, soda, sulfate or sulphite pulp, mechanical pulp, chemithermomechanical pulp (CTMP), thermomechanical pulp (TMP), nanopulp or recycled pulp or mixtures thereof. The raw material may be based on softwood, hardwood, recycled fibers or non-wood based pulp suitable for making paper or board.

The fibrous suspension may, in addition to the fibers, further comprise one or more other process or functional additives, e.g. selected from the group of fillers, pigments, wet and dry strength agents, retention agents, cross-linkers, softeners or plasticizers, adhesion primers, fixatives, debonders, wetting agents, optical dyes/agents, fluorescent whitening agents, de-foaming agents, and hydrophobizing agents, such as AKD, ASA, waxes, resins, etc.

The fibrous suspension may comprise fibers made from regenerated cellulose, e.g. viscose or lyocell fibers and/or synthetic fibers such as polymeric fibers. The polymeric fibers is preferably fibers from polyolefin or polyesters such as polyethylene terephthalate.

In one embodiment the fibrous suspension further comprises microfibrillated cellulose.

The porous medium, to which the fibrous suspension is provided, may be, for example, a wire or a membrane.

By "substrate comprising fibers" is herein meant a base web or sheet comprising fibers, such as cellulose or synthetic fibers.

The term "dewatering" as used herein encompasses any form of dewatering, including for example evaporation, dewatering under pressure, dewatering using radiation, ultrasound, vacuum or suction boxes, etc. The dewatering may be carried out in one or more steps and may involve one form of dewatering or several forms of dewatering in combination.

In embodiments including use of a porous wire, dewatering on the porous wire may be performed using known techniques with single wire or twin wire system, frictionless dewatering, membrane-assisted dewatering, vacuum- or ultrasound assisted dewatering, etc. Furthermore, after the wire section, the substrate is in these embodiments further dewatered and dried by e.g. mechanical dewatering, hot air, radiation drying, convection drying, etc. By "mechanical dewatering" is meant dewatering performed by means of mechanical forces, e.g. by means of mechanical pressing including shoe press.

Microfibrillated cellulose (MFC) shall in the context of the present disclosure mean a nano scale cellulose particle fiber or fibril with at least one dimension less than 100 nm. MFC comprises partly or totally fibrillated cellulose or lignocellulose fibers. The liberated fibrils have a diameter less than 100 nm, whereas the actual fibril diameter or particle size distribution and/or aspect ratio (length/width) depends on the source and the manufacturing methods.

The smallest fibril is called elementary fibril and has a diameter of approximately 2-4 nm (see e.g. Chinga-Carrasco, G., *Cellulose fibres, nanofibrils and microfibrils: The morphological sequence of MFC components from a plant physiology and fibre technology point of view*, Nanoscale research letters 2011, 6:417), while it is common that the aggregated form of the elementary fibrils, also defined as microfibril (Fengel, D., *Ultrastructural behavior of cell wall polysaccharides*, Tappi J., March 1970, Vol 53, No. 3.), is the main product that is obtained when making MFC e.g. by using an extended refining process or pressure-drop disintegration process. Depending on the source and the manufacturing process, the length of the fibrils can vary from around 1 to more than 10 micrometers. A coarse MFC grade might contain a substantial fraction of fibrillated fibers, i.e. protruding fibrils from the tracheid (cellulose fiber), and with a certain amount of fibrils liberated from the tracheid (cellulose fiber).

There are different acronyms for MFC such as cellulose microfibrils, fibrillated cellulose, nanofibrillated cellulose, fibril aggregates, nanoscale cellulose fibrils, cellulose nanofibers, cellulose nanofibrils, cellulose microfibers, cellulose fibrils, microfibrillar cellulose, microfibril aggregrates and cellulose microfibril aggregates. MFC can also be characterized by various physical or physical-chemical properties such as large surface area or its ability to form a gel-like material at low solids (1-5 wt %) when dispersed in water. The cellulose fiber is preferably fibrillated to such an extent that the final specific surface area of the formed MFC is from about 1 to about 300 $m^2/g$, such as from 1 to 200 $m^2/g$ or more preferably 50-200 $m^2/g$ when determined for a freeze-dried material with the BET method.

Various methods exist to make MFC, such as single or multiple pass refining, pre-hydrolysis followed by refining or high shear disintegration or liberation of fibrils. One or several pre-treatment step is usually required in order to make MFC manufacturing both energy efficient and sustainable. The cellulose fibers of the pulp to be supplied may thus be pre-treated enzymatically or chemically, for example to reduce the quantity of hemicellulose or lignin. The cellulose fibers may be chemically modified before fibrillation, wherein the cellulose molecules contain functional groups other (or more) than found in the original cellulose. Such groups include, among others, carboxymethyl (CM), aldehyde and/or carboxyl groups (cellulose obtained by N-oxyl mediated oxydation, for example "TEMPO"), or quaternary ammonium (cationic cellulose). After being modified or oxidized in one of the above-described methods, it is easier to disintegrate the fibers into MFC or nanofibrillar size fibrils.

The nanofibrillar cellulose may contain some hemicelluloses; the amount is dependent on the plant source and on the cooking process of the pulp. Mechanical disintegration of the pre-treated fibers, e.g. hydrolysed, pre-swelled, or oxidized cellulose raw material is carried out with suitable equipment such as a refiner, grinder, homogenizer, colloider, friction grinder, ultrasound sonicator, fluidizer such as microfluidizer, macrofluidizer or fluidizer-type homogenizer. Depending on the MFC manufacturing method, the product might also contain fines, or nanocrystalline cellulose or e.g. other chemicals present in wood fibers or in papermaking process. The product might also contain various amounts of micron size fiber particles that have not been efficiently fibrillated.

MFC is produced from wood cellulose fibers, both from hardwood or softwood fibers. It can also be made from microbial sources, agricultural fibers such as wheat straw pulp, bamboo, bagasse, or other non-wood fiber sources. It is preferably made from pulp including pulp from virgin fiber, e.g. mechanical, chemical and/or thermomechanical pulps. It can also be made from broke or recycled paper.

The above described definition of MFC includes, but is not limited to, the new proposed TAPPI standard W13021 on cellulose nanofibril (CMF) defining a cellulose nanofiber material containing multiple elementary fibrils with both crystalline and amorphous regions.

In accordance with the above, the first additive suspension comprises MFC. However, in embodiments of the method of the first aspect, the first additive suspension comprises, in addition to MFC, at least one further component selected from the group of retention agents, drainage agents, fillers, debonding agents, de-foaming agents, colorants, optical agents, internal sizing agents, fixatives and strengthening agents.

In embodiments of the method of the first aspect, the first additive suspension comprises, in addition to MFC, at least one second strengthening agent selected from the group of starch, such as starch particles, granules or dissolved starch, synthetic binders, such as latex, modified biopolymers, such as modified starches, proteins, and other natural polysaccharides, such as sodium carboxymethyl cellulose, guar gum, hemicelluloses or lignin. The second strengthening agent may then work as a co-strengthening agent together with the first strengthening agent (i.e. the microfibrillated cellulose). In embodiments of the method of the first aspect, the first additive suspension comprises, in addition to MFC, starch, such as starch particles, granules or dissolved starch.

In accordance with the above, the second additive suspension comprises at least one retention agent and/or at least one drainage agent. The at least one retention agent may, for example, be selected from the group of nano- or microparticles such as nanosilica or colloidal anionic or cationic silica, bentonite, nanoclays, nanocellulose, and/or polymers preferably PAM, CPAM, APAM, PDADMAC, PVAm, cationic or anionic starch, polyethylene imine, polyamines, polyamineamides, polyethylene oxides, phenolic resins, etc. It is often preferred that the retention agent comprises two or three different components, such as a dual-component retention system. The retention system can also comprise one or several microparticles and one or two retention polymers. The at least one drainage agent may, for example, be selected from the group of polyethylene imines, PAC, alum, and other low molecular weight charged polymers. As known by a person skilled in the art, drainage can be optimized by using various microparticles and polymers but the performance is often dependent on pulp type(s), machine speed, conductivity, dewatering section, pH, charge and/or cationic demand, white water consistency, temperature and other chemicals or additives.

In embodiments of the method of the first aspect, at least one retention agent of said second additive suspension comprises nanoparticles or microparticles.

In embodiments of the method of the first aspect, the second additive suspension comprises at least two retention agents, wherein one of said at least two retention agents comprises microparticles or nanoparticles and one of said at least two retention agents comprises a cationic, anionic or amphoteric polymer.

The microparticles or nanoparticles of the second additive suspension may be cationic or anionic at neutral, acid or alkaline pH.

The microparticles or nanoparticles of the second additive suspension may comprise silica such as colloidal silica, microsilica or solgel silica, or bentonite, such as micro or nanobentonite, or clay particles.

In embodiments of the method of the first aspect, the second additive suspension comprises, in addition to the at least one retention agent and/or the at least one drainage agent, at least one further component selected from the group of strengthening agents, fillers, debonding agents, de-foaming agents, colorants, optical agents, internal sizing agents and fixatives.

In embodiments of the method of the first aspect, the second additive suspension comprises, in addition to the at least one retention agent and/or the at least one drainage agent, at least one strengthening agent selected from the group of microfibrillated cellulose, starch, such as starch particles, granules or dissolved starch, synthetic binders, such as latex, modified biopolymers, such as modified starches, proteins, and other natural polysaccharides, such as sodium carboxymethyl cellulose, guar gum, hemicelluloses or lignin.

By the term "multilayer curtain coating" is herein meant addition of two or more coating layers to a substrate by means of any suitable curtain coating apparatus(es)/equipment, such as slot die, slide die, falling die, or similar dosing systems based on one or several slots.

In embodiments of the method of the first aspect the layers added to the substrate by means of the multilayer curtain coating are added simultaneously, i.e. the two or more coating layers added by means of the multilayer curtain coating are added simultaneously to the substrate within one curtain coating station by means of any suitable curtain coating apparatus/equipment (e.g. a multilayer curtain coater) at the same, or essentially the same, dry content of the substrate. Thus, coating layers added simultaneously to the substrate by means of multilayer curtain coating may be added on top of each other at the position of addition to the substrate.

In embodiments of the method of the first aspect the layers added to the substrate by means of the multilayer curtain coating are added non-simultaneously, i.e. the two or more coating layers added by means of the multilayer curtain coating are added non-simultaneously to the substrate by means of any suitable curtain coating apparatuses/equipment (which may be positioned in one separate curtain coating station for each layer).

The location of the layers added to the substrate may vary. The first additive suspension preferably forms a first layer and the second additive suspension preferably forms a second layer on the substrate. The first layer may be located in between the substrate and the second layer. It may also be possible that the second layer is located in between the substrate and the first layer.

In embodiments of the method of the first aspect three or more layers are added to the substrate by means of the multilayer curtain coating and the layers are added by means of a combination of simultaneous and non-simultaneous addition.

For example, two or more layers may be added simultaneously to the substrate by means of the multilayer curtain coating and one or more further layer may be added to the substrate non-simultaneously with the mentioned two or more layers by means of the multilayer curtain coating. The two or more simultaneously added layers may then be added in one curtain coating station and the one or more further layer may be added in one separate curtain coating station for each layer.

As another example, two or more layers of a first group of layers may be added simultaneously to the substrate by means of the multilayer curtain coating and two or more layers of a second group of layers may be added simultaneously (but non-simultaneously with the layers of the first group) to the substrate by means of the multilayer curtain coating.

Layers added non-simultaneously to the substrate by means of the multilayer curtain coating may be added in any suitable order. For example, one layer of the first additive suspension may be added to the substrate when it has a first dry content and one layer of the second additive suspension may be added to the substrate when it has a second dry content, wherein the first dry content is lower than the second dry content or vice versa.

When comparing the width of any two layers of the layers added by means of the multilayer curtain coating, the width of the compared two layers may be the same or different.

In accordance with the above, the multi-layer curtain coating is performed during the step of dewatering of the substrate on the porous medium, wherein the substrate has a dry content of less than 20 weight-%, preferably less than 10 weight-%, most preferably less than 7 weight-%, at coating (i.e. additive addition) with the multi-layer coating equipment. Thus, all layers added by means of the multilayer curtain coating are added when the substrate has the specified dry content during dewatering on the porous medium.

Thus, in embodiments in which the two or more coating layers are added simultaneously to the substrate by the multilayer curtain coating, the curtain coating equipment is positioned such that the two or more coating layers are added simultaneously to the substrate at a position at which it has the specified dry content during dewatering on the porous medium. In embodiments in which the coating layers are added non-simultaneously to the substrate by the multilayer curtain coating, the curtain coating equipment is positioned such that each of the two or more coating layers are added to the substrate at positions at which it has the specified dry content during dewatering on the porous medium.

In one embodiment the substrate has a dry content of less than 20 weight-%, such as more than 0.5 weight-%, 1.0 weight-%, 1.5 weight-% or 2 weight-% but less than 20 weight-%, when the additive addition is performed (i.e. at coating with the multi-layer coating equipment). In one embodiment the substrate has a dry content of less than 10 weight-%, such as more than 0.5 weight-%, 1.0 weight-%, 1.5 weight-% or 2 weight-% but less than 10 weight-%, at coating with the multi-layer coating equipment. In one embodiment the substrate has a dry content of less than 7 weight-%, such as more than 0.5 weight-%, 1.0 weight-%, 1.5 weight-% or 2 weight-% but less than 7 weight-%, at coating with the multi-layer coating equipment. In one embodiment the substrate has a dry content of less than 5 weight-%, such as more than 0.5 weight-%, 1.0 weight-%, 1.5 weight-% or 2 weight-% but less than 5 weight-%, at coating with the multi-layer coating equipment.

By "dry content" is meant content of dry matter in a slurry, suspension or solution. That is, for example 50% dry content means that the weight of the dry matter is 50%, based on the total weight of the solution, suspension or slurry. Analogously, by "dry weight" is meant the weight of dry matter.

In accordance with the above, the method of the first aspect may comprise adding one layer of the first additive suspension and one layer of the second additive suspension by means of the multilayer curtain coating. However, alternatively, the method of the first aspect may comprise adding more than one layer of the first additive suspension and/or more than one layer of the second additive suspension.

In embodiments of the method of the first aspect, the method further comprises adding one or more layer of one or more further additive suspension to said substrate by means of said multilayer curtain coating (i.e. in addition to the layer(s) of the first additive suspension and the layer(s) of the second additive suspension). The one or more further additive suspension may comprise at least one component selected from the group of strengthening agents, retention agents, drainage agents, fillers, debonding agents, de-foaming agents, colorants, optical agents, internal sizing agents and fixatives. Thus, one or more strengthening agents may be included in the one or more further additive suspensions. The one or more strengthening agents of the further additive suspension(s) may be selected from the group of microfibrillated cellulose, starch, such as starch particles, granules or dissolved starch, synthetic binders, such as latex, modified biopolymers, such as modified starches, proteins, and other natural polysaccharides, such as sodium carboxymethyl cellulose, guar gum, hemicelluloses or lignin.

In embodiments of the method of the first aspect, the total amount of microfibrillated cellulose added to the substrate by the additive addition is 0.1-30 kg on dry basis per ton of said provided first ply.

In embodiments of the method of the first aspect, the total amount of retention agent(s) and/or drainage agent(s) added to the substrate by the additive addition is 10 g-5 kg on dry basis per ton of said provided first ply.

In accordance with the above, the substrate is further dewatered and dried after the dewatering on the porous medium so as to provide said first ply. The further dewatering and drying are performed after the porous medium section, which may be a wire section in accordance with the above, by any suitable means.

The product produced by the method of the present disclosure may be a paper or board product that may be a one-ply paper or board product or a multi-ply paper or board product.

The paper or board product produced by the method of the present disclosure may have a basis weight of 20-600 g/m$^2$ or more preferably 30-500 g/m$^2$. The first ply may have a basis weight of 20-200 g/m$^2$ or more preferably between 30-150 g/m$^2$.

In embodiments of the method of the first aspect, the produced product is a multi-ply paper or board product, wherein the method further comprises a step of attaching said provided first ply to at least one further ply. Each respective further ply may be provided by the same method steps as the first ply, i.e. each respective further ply may be similar to the first ply or may be different.

The present disclosure relates also to a paper or board product obtainable according to the method of the present disclosure.

The present disclosure relates also to a non-woven product obtainable according to the method of the present disclosure.

In view of the above detailed description of the present invention, other modifications and variations will become apparent to those skilled in the art. However, it should be apparent that such other modifications and variations may be effected without departing from the spirit and scope of the invention defined in the appended claims.

The invention claimed is:

1. A method for production of a product comprising a first ply, the method comprising the steps of:

providing a fibrous suspension comprising fibers;

providing said fibrous suspension to a porous medium to form a substrate comprising fibers;

providing a first additive suspension comprising a first strengthening agent, wherein the first strengthening agent is microfibrillated cellulose;

providing a second additive suspension comprising at least one retention agent, at least one drainage agent, or both;

dewatering said substrate on said porous medium;

performing additive addition to said substrate during said dewatering of said substrate on said porous medium, wherein the additive addition is performed when the substrate has a dry content of less than 20 weight-%, and wherein the additive addition comprises adding at least a layer of said first additive suspension and a layer of said second additive suspension to said substrate with a multilayer curtain coating, and further dewatering and drying said substrate after said dewatering on said porous medium so as to provide said first ply.

2. The method according to claim 1, wherein the layers added to the substrate with the multilayer curtain coating are added simultaneously.

3. The method according to claim 1, wherein the layers added to the substrate with the multilayer curtain coating are added non-simultaneously.

4. The method according claim 1, wherein said first additive suspension comprises at least one further component selected from the group consisting of retention agents, drainage agents, fillers, debonding agents, de-foaming agents, colorants, optical agents, internal sizing agents, fixatives and strengthening agents.

5. The method according to claim 1, wherein said first additive suspension comprises at least one second strengthening agent selected from the group consisting of starch, synthetic binders, modified biopolymers, proteins, and natural polysaccharides.

6. The method according to claim 1, wherein said second additive suspension comprises at least one further component selected from the group consisting of strengthening agents, fillers, debonding agents, de-foaming agents, colorants, optical agents, internal sizing agents and fixatives.

7. The method according to claim 6, wherein said second additive suspension comprises at least one strengthening agent selected from the group consisting of microfibrillated cellulose, starch, synthetic binders, modified biopolymers, proteins, and natural polysaccharides.

8. The method according to claim 1, wherein a total amount of microfibrillated cellulose added to said substrate by said additive addition is between 0.1-30 kg on dry basis per ton of said provided first ply.

9. The method according to claim 1, wherein a total amount of retention agent(s), a total amount of drainage agent(s), or a total amount of retention agent(s) and drainage agent(s)added to said substrate by said additive addition is between 10 g -5 kg on dry basis per ton of said provided first ply.

10. The method according to claim 1, wherein at least one retention agent of said second additive suspension comprises nanoparticles or microparticles.

11. The method according to claim 10, wherein said microparticles or nanoparticles are cationic or anionic at neutral, acid, or alkaline pH.

12. The method according to claim 10, wherein said microparticles or nanoparticles comprise silica, bentonite, or clay particles.

13. The method according to claim 1, wherein said second additive suspension comprises at least two retention agents, wherein one of said at least two retention agents comprises microparticles or nanoparticles and the other of said at least two retention agents comprises a cationic, anionic, or amphoteric polymer.

14. The method according to claim 1, wherein said fibers of said fibrous suspension comprise cellulose fibers, chemi-thermomechanical pulp (CTMP), thermomechanical pulp (TMP), mechanical pulp, nanopulp, or recycled pulp or mixtures thereof.

15. The method according to claim 14, wherein said cellulose fibers has a Schopper Riegler value of 12-50°.

16. The method according to claim 1, wherein the fibers in the suspension are fibers made from regenerated cellulose, synthetic fibers, or both.

17. The method according to claim 1, wherein said fibrous suspension further comprises microfibrillated cellulose.

18. The method according to claim 1, wherein the product is a multi-ply paper or board product and wherein the method further comprises a step of attaching said provided first ply to at least a second ply.

* * * * *